US006119678A

United States Patent [19]

Marchand

[11] Patent Number: 6,119,678

[45] Date of Patent: Sep. 19, 2000

[54] APPLIANCE CONSOLE INCLUDING A GLASS TOUCH SENSOR CONTROL PANEL BORDERED BY A ONE-PIECE PLASTIC ENCAPSULATION

[75] Inventor: Brian F. Marchand, Penetanguishene, Canada

[73] Assignee: Gemtron Corporation, Sweetwater, Tenn.

[21] Appl. No.: 09/223,309

[22] Filed: Dec. 30, 1998

[51] Int. Cl.[7] ..... F24C 15/00; A47B 96/00

[52] U.S. Cl. ..... 126/39 B; 126/50; 126/211; 312/236; 312/327; 312/228; 34/88

[58] Field of Search ..... 126/37 A, 37 B, 126/39 B, 39 C, 39 H, 211, 50; 312/236, 204, 228, 234, 279, 327; 34/88, 89

[56] References Cited

U.S. PATENT DOCUMENTS

| | | | |
|---|---|---|---|
| 3,253,874 | 5/1966 | Czech | 312/279 |
| 4,243,016 | 1/1981 | Kristen et al. . | |
| 4,268,098 | 5/1981 | Kretchman et al. | 312/228 |
| 4,453,533 | 6/1984 | Scheidler et al. . | |
| 4,765,698 | 8/1988 | Dooley | 312/248 |
| 4,798,424 | 1/1989 | Coates et al. | 312/279 |
| 5,036,831 | 8/1991 | Ray . | |
| 5,153,572 | 10/1992 | Caldwell et al. . | |
| 5,183,996 | 2/1993 | Hazan et al. . | |
| 5,185,047 | 2/1993 | Ray . | |
| 5,189,417 | 2/1993 | Caldwell et al. . | |
| 5,239,152 | 8/1993 | Caldwell et al. . | |
| 5,273,354 | 12/1993 | Herrmann et al. . | |
| 5,362,145 | 11/1994 | Bird et al. . | |
| 5,403,084 | 4/1995 | Kane et al. . | |
| 5,429,144 | 7/1995 | Wilk . | |
| 5,429,433 | 7/1995 | Bird et al. . | |
| 5,441,338 | 8/1995 | Kane et al. . | |
| 5,454,638 | 10/1995 | Bird et al. . | |
| 5,524,981 | 6/1996 | Herrmann et al. . | |
| 5,540,493 | 7/1996 | Kane et al. . | |
| 5,564,809 | 10/1996 | Kane et al. . | |
| 5,572,205 | 11/1996 | Caldwell et al. . | |
| 5,589,957 | 12/1996 | Aritake et al. . | |
| 5,660,770 | 8/1997 | Wernicke et al. . | |
| 5,705,113 | 1/1998 | Kane et al. . | |
| 5,735,589 | 4/1998 | Herrmann et al. . | |
| 5,738,424 | 4/1998 | Katz et al. | 312/279 |
| 5,785,047 | 7/1998 | Bird et al. | 126/39 H |
| 5,971,510 | 10/1999 | Lickiss et al. | 312/228 |

FOREIGN PATENT DOCUMENTS

| | | | |
|---|---|---|---|
| 388375 | 9/1990 | European Pat. Off. | 126/42 |

*Primary Examiner*—Ira S. Lazarus
*Assistant Examiner*—Sara Clarke
*Attorney, Agent, or Firm*—Diller, Ramik & Wight, PC

[57] ABSTRACT

An appliance, such as a cooking range, a clothes dryer, a clothes washer, an oven or the like, includes a console along a rear edge of the appliance which can pivot between an upright in-use position and a lower shipping, repair and/or servicing position. The console is preferably of a two-part construction including a front housing body having an integrally injection molded encapsulation or frame peripherally retaining a touch sensor control panel which can be readily accessed when the console is in its lower repair position.

37 Claims, 2 Drawing Sheets

FIG. 1
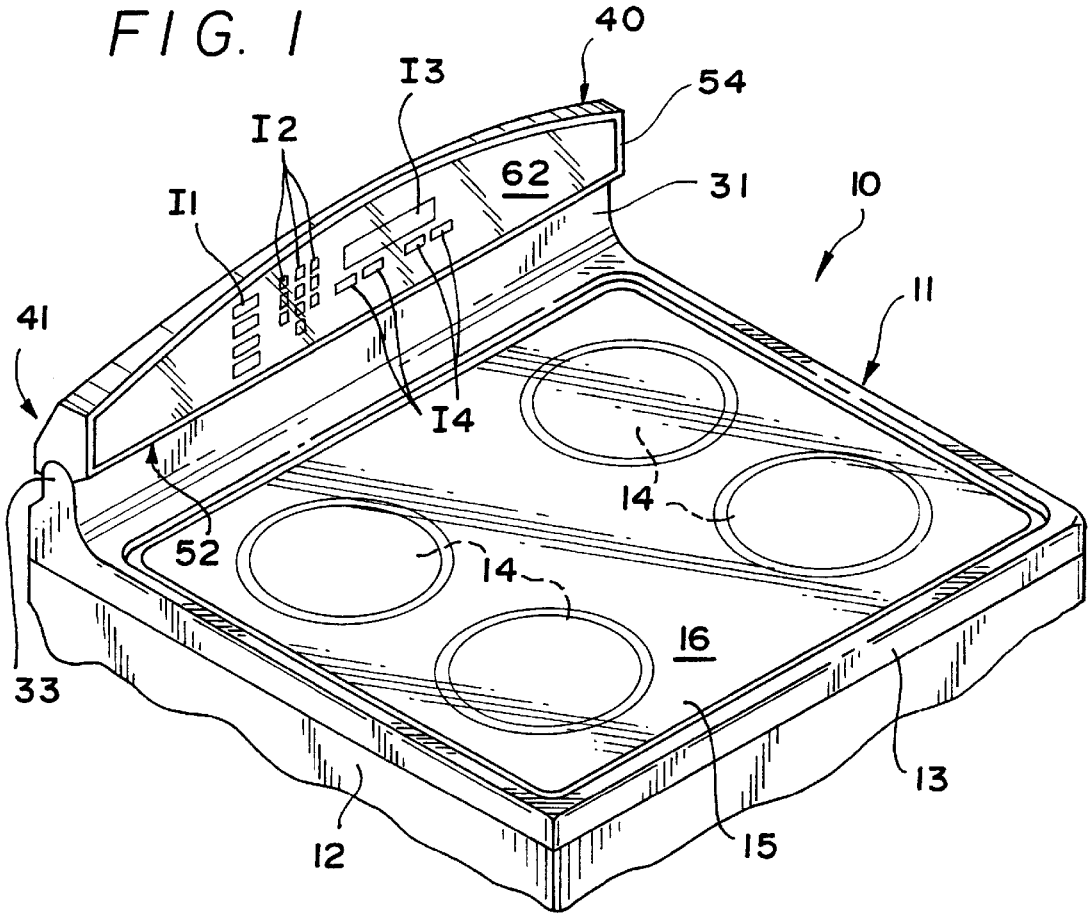
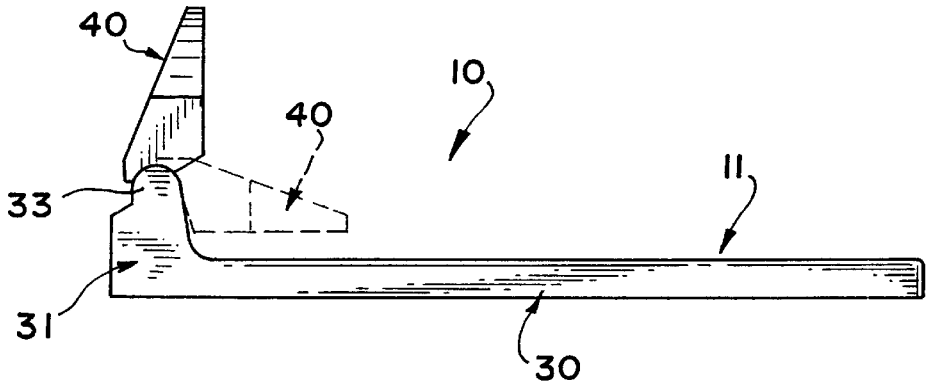
FIG. 2

APPLIANCE CONSOLE INCLUDING A GLASS TOUCH SENSOR CONTROL PANEL BORDERED BY A ONE-PIECE PLASTIC ENCAPSULATION

BACKGROUND OF THE INVENTION

It is conventional to provide appliances, such as clothes washers, dishwashers, cooking ranges, baking ovens or the like with control consoles. Such consoles generally extend along a rear edge of an upper surface of an associated appliance and are a rigid portion thereof. Such consoles generally include a front-facing wall observable to the user which carries conventional controls, be they push-buttons, dials, touch sensor controls or the like. A separate rear panel closes the console or alternatively a rear panel of the entire appliance has an upper portion which closes the rear of the console and the conventional control mechanisms housed therein.

Such conventional appliances, be they "white" goods or "brown" goods, present several problems, such as the cost involved in shipping such appliances in conventional cardboard or corrugated board cartons or packaging. The total height of the carton must include the maximum vertical height of the appliance from its bottom to the top of the console. Since the console projects anywhere between four to eight inches above the top panel, each carton must be of a total height to accommodate the "major" height of the appliance plus the additive "console" height. It is prohibitively expensive to score and blank corrugated board to match the exterior contour of the appliance and, therefore, corrugated cartons are necessarily wasteful of paperboard because such cartons are of an overall height corresponding to the total height of the appliance, including the console projecting above the top panel.

Another problem associated with such conventional upright consoles is the tendency of homeowners, installers, service personnel, etc. to utilize the upright console as a "gripping" or "handle" portion. It is not uncommon to see a serviceman stand in front of an appliance, reach across the top surface, grasp opposite corners of the console and apply pushing, pulling, torquing and/or lifting forces to place the appliance in a desired location or remove the appliance therefrom. Consoles are not necessarily sufficiently sturdy to accommodate this type of misuse and damage thereto is not uncommon.

Another problem with such conventional consoles is the difficulty of accessing the console interior for servicing and/or repair. If the appliance is located with its rear panel against a vertical wall, as is most likely the case when dealing with clothes washers, clothes dryers, ranges or the like, the vertical wall generally precludes access to the console interior or renders the same extremely cumbersome. In most cases a serviceman would find it necessary to pull the appliance away from the wall, again most likely grasping the console, and creating the damage heretofore described. However, even after pulling the appliance away from the wall, the rear panel of the entire appliance most often must be removed to gain access to the console interior. If the console itself has a separate rear panel, removing the panel is relatively simple, but repair to the interior controls presents an access problem, unless the serviceman or repairman can actually get behind the appliance or the appliance can be rotated or turned sufficiently to allow access to the console interior from the backside.

SUMMARY OF THE INVENTION

In keeping with the foregoing, a primary object of the present invention is to provide a novel improvement in an appliance, such as a range, a clothes washer, a clothes dryer or the like, which includes a console normally projecting substantially upright from a top surface or panel of the appliance when in use while being pivoted to a lower position for purposes of shipment and service and/or repair. Since the console can be pivoted to a lower "shipping" position, the overall vertical height of a corrugated carton associated therewith can be appreciably reduced, as compared to a carton in which is packaged a like appliance whose console must remain upright. By pivoting the console of the present invention to its lowermost position, a tremendous savings in the costs of corrugated board packaging is achieved when one reflects upon the tremendous numbers of appliances manufactured, packaged and shipped per year throughout the United States. Furthermore, since the console is pivoted to a lower position during shipment, it is essentially located out-of-harm's-way, as opposed to an upright console which is totally unprotected by the overall perimeter of the appliance itself.

The lowermost position of the console also facilitates servicing from above in the absence of moving the appliance from its position of use. One need but gain ready access to the interior of the console and the control mechanisms thereof, and this is achieved through a novel essentially two-part console body of which the front part is formed of a temper glass panel surrounded by an integral injection molded, encapsulation, rim or frame which is preferably snap-secured or otherwise secured to the rear part of the console body. An interior surface of the tempered glass panel carries conventional touch controls, and these are readily accessible when the console bodies are "opened." As an alternative to the snap-securement of the front part or touch control panel frame to a periphery of the rear housing or rear part, an access panel of the rear part or rear housing can be readily removably secured thereto. With the access panel removed and the console in its lowermost service/repair position, the interior of the console is accessed through the access opening of the console rear housing or body thereby providing service/repair access essentially from above in an accessible fashion.

Since the encapsulation, rim or frame is injection molded, it is a relatively simple proposition to "color coordinate" a particular frame or rim relative to a particular appliance color. For example, if the appliance were to be white in color, the entire console, including the console rear body and the encapsulation, rim or frame, would be white with a tempered glass panel thereof decorated for functional and aesthetic purposes. The tempered glass panel could, for example, be stencil screened and oven dried in-line to vary the indica thereon depending upon end use and customer demand. However, a generally "universal" console could be provided in keeping with this invention for both "white" and "brown" goods with the only variation between the products being the particular indicia upon the tempered glass panel and the touch sensor controls associated therewith.

With the above and other objects in view that will hereinafter appear, the nature of the invention will be more clearly understood by reference to the following detailed description, the appended claims and the several views illustrated in the accompanying drawings.

BRIEF DESCRIPTION OF THE DRAWINGS

FIG. 1 is a top perspective view of an upper portion of an appliance constructed in accordance with this invention, and illustrates a console in an upright position along a rear edge of the appliance upper portion.

FIG. 2 is a side elevational view of the appliance of FIG. 1, and illustrates in phantom outline a shipping and servicing position of the console pivoted down from its upright in-use position.

DESCRIPTION OF THE PREFERRED EMBODIMENTS

Figure 3:
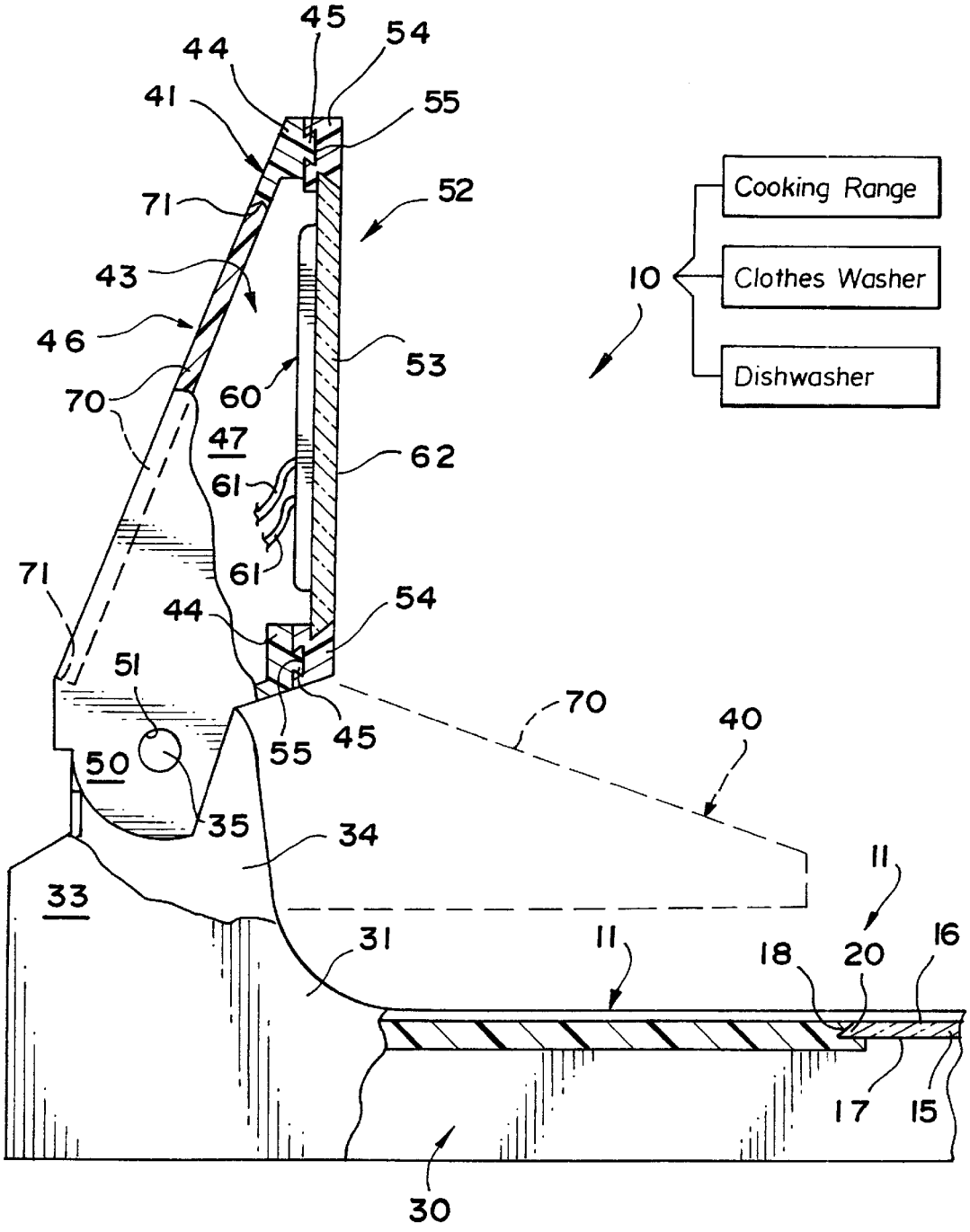
FIG. 3 is a highly enlarged fragmentary cross-sectional view of portions of a top panel of the appliance upper portion and the console, and illustrates details of the construction thereof.

A novel appliance constructed in accordance with this invention is generally designated by the reference numeral 10 (FIGS. 1 through 3), and for purposes of description the appliance 10 is a cooking range, though it may as well be a clothes washer or a dishwasher (FIG. 3), which includes a substantially horizontally disposed upper portion or top panel member 11, two parallel side walls 12 of which only one is shown and a front wall 13. The front wall 13 might include, for example, a door (not shown) for accessing a conventional oven, and opposite the front wall is a conventional rear wall (not shown).

The upper or top panel member 11 is constructed as a cook top, hob top or the like, and includes four heating elements 14 secured beneath a substantially planar glass/ceramic panel or plate 15, such as Ceran®. The panel 15 includes an uppermost surface 16, a lowermost surface 17 (FIG. 3), and an outermost peripheral edge 18 defining an outermost peripheral edge portion 20 of a generally polygonal/rectangular configuration.

In the case of a clothes washer or a dishwasher, the appliance 10 (FIG. 3) would exclude the heating elements 14 and include conventional means for respectively washing clothes and dishes (not shown).

Encapsulation means 30 in the form of a substantially one-piece, homogeneous, injection molded, polymeric/copolymeric rim or frame peripherally surrounds the panel 15 and includes an integral upstanding rear wall or wall portion 31 having opposite upstanding legs or ears 33 (FIG. 1) and 34 (FIG. 3) from each of which projects a pivot pin 35 (FIG. 3). The pivot pins 35 of the upstanding legs 33, 34 are in axial alignment and function to pivotally connect a console 40 to the upstanding legs 33, 34 of the encapsulation 30.

The console 40 includes a rear housing body 41 and a front housing body 52 collectively defining therebetween an interior chamber 43.

The rear housing body 41 is preferably of an injection molded, one-piece, polymeric/copolymeric, homogeneous construction and includes a front peripheral edge portion 44 of a generally contoured polygonal configuration having one continuous dovetail connector or a plurality of integral dovetail connectors 45, a rear panel 46, and opposite side panels 47, 48 each having a depending ear 50 (FIG. 3) which in turn includes a circular opening 51 receiving one of the pivot pins 35.

The front housing body 52 includes a tempered glass panel 53 and a substantially one-piece, homogenous, injection molded, polymeric/copolymeric encapsulation, rim or frame 54 having a single continuous dovetail recess or a plurality of integral dovetail recesses 55 in which are snap-secured the dovetail connector or connectors 45. Within the chamber 43 of the console 40 is located conventional touch sensor control means generally designated by the reference numeral 60 which is in part associated with, defined by or secured to a rear surface (unnumbered) of the tempered glass panel 53 and from which extend conventional electrical leads 61 which are adapted for connection to a source of electricity, the heating elements 14, etc. The touch sensor control means and/or touch sensor control circuit 60 might be, for example, a conventional touch sensor control system utilizing, for example, a capacitive touch sensor panel defined in part by the glass panel 53, such as is fully disclosed in U.S. Pat. Nos. 5,153,572; 5,239,152; 5,189,417; and 5,572,205.

The glass panel 53 includes various indicia I1 through 14 viewable through a front surface 62 of the panel 53. The indicia I1 through 14 correlate functions designated thereby to functions performed by various aspects of the overall operation of the range 10 as, for example, identifying which of the four heating elements 14 are to be energized by selectively touching a selected one of the four indicia I4. Power input for a particular heating element 14 can be regulated through the indicia I2 while the indicia I3 could be a LED clock. Further details of the touch sensor control means 60 can include the details of the touch control 10 of U.S. Pat. No. 5,572,205, for example, which are incorporated herein by reference.

The console 40 is shown in FIG. 1 and in solid lines in FIG. 3 in its substantially upright in-use position, but in the phantom outline position of the console 40 in FIGS. 2 and 3 the console 40 is illustrated in its shipping, service and/or repair position. This lower position achieves the savings in corrugated board heretofore described because of the reduction in overall appliance height and, of course, servicing and/or repair can be readily achieved in this position by providing the rear panel 46 of the rear housing body 41 with a removable access panel 70 having a polygonal peripheral edge 71 to define a like contoured access opening (not shown) in the rear panel 46. In such case, when the removable rear access panel 70 of the rear panel 46 is removed, the interior of the housing 43 is accessible from above when the console 40 is in the phantom outline position shown in FIG. 3. Alternatively, the console 40 can be maintained in its upright position, and the front housing body 52 can be removed therefrom by unsnapping the dovetail connector or connectors 45, 55 and simply place the front housing body 52 with its surface 62 substantially horizontal and lowermost upon the top panel member 11 to gain access to the control mechanism 60 for purposes of maintenance, service and/or repair. Obviously, the conductors 61 are of a sufficient length to permit such relative movement and positioning.

In further keeping with this invention the frame-like encapsulation 30 and the frame-like encapsulation 54 are each injection molded to the overall configuration shown in the drawings in intimate bonded relationship to the respective peripheral edges of the panels 15, 53 by an injection molded process corresponding to those disclosed in U.S. Pat. Nos. 5,273,354; 5,362,145; 5,403,084; 5,429,433; 5,540,493; 5,441,338; 5,454,638; 5,524,981; 5,540,493; 5,564,809; 5,660,770; 5,705,113; 5,735,589 and 5,785,047, the disclosures of which are incorporated herein by reference. During the injection molding process, the frames, rims or encapsulations 30, 54 are each formed as a one-piece, substantially homogeneous, injection molded, synthetic, polymeric/copolymeric plastic material member entirely encapsulating the peripheral portion of the panels 15, 53.

Other details of cook tops applicable to the panel 15 and the heating elements 14 thereof are common in such patents as U.S. Pat. Nos. 4,243,016; 4,453,533; 5,036,831; 5,183,996; 5,185,047; 5,429,144; 5,589,957 and 5,785,047, the disclosures of which are also incorporated herein by reference, particularly with respect to the details of the cook top panel and the integral injection molded encapsulation peripherally surrounding the same.

The console 40 can also be pivoted counterclockwise from the solid outline position shown in FIG. 3 to position the panel 53 at any one of a number of different angles to achieve optimum user convenience. Tall persons might desire the console 40 to pivoted further back from the position shown in FIG. 3 while the opposite might be desired for a shorter person. Additionally, depending upon ambient or artificial light in the areas of use, the console 40 could be selectively pivotally adjusted to reduce glare or to optimize light cast upon the control panel 53.

Although a preferred embodiment of the invention has been specifically illustrated and described herein, it is to be understood that minor variations may be made in the apparatus without departing from the spirit and scope of the invention, as defined the appended claims.

What is claimed is:

1. An improvement in an appliance comprising a substantially horizontally disposed first panel member, a second panel member disposed substantially along a first edge of said first panel member, means for pivoting said second panel member for movement relative to said first panel member between a first relatively upright position of said second panel member and a second position of said second panel member angularly offset from said first position toward said first panel member, at least one of said first and second panel members including a panel having a peripheral edge substantially entirely encapsulated by a peripheral frame of one-piece molded synthetic polymeric/copolymeric plastic material, and said at least one of said first and second panel members is each of said first and second panel members.

2. The improvement as defined in claim 1 wherein said pivoting means pivotally unites said at least one panel member peripheral edge through its peripheral frame to the other of said first and second panel members.

3. An improvement in an appliance comprising a substantially horizontally disposed first panel member, a second panel member disposed substantially along a first edge of said first panel member, means for pivoting said second panel member for movement relative to said first panel member between a first relatively upright position of said second panel member and a second position of said second panel member angularly offset from said first position toward said first panel member, at least one of said first and second panel members including a panel having a peripheral edge substantially entirely encapsulated by a peripheral frame of one-piece molded synthetic polymeric/copolymeric plastic material, and said pivoting means pivotally unites said peripheral edge of said at least one of said first and second panel members to the other of said first and second panel members.

4. The improvement as defined in claim 3 wherein said at least one of said first and second panel members is said first panel member.

5. The improvement as defined in claim 3 wherein said at least one of said first and second panel member is said second panel member.

6. The improvement as defined in claim 3 wherein said at least one of said first and second panel members is said second panel member, and means for manually controlling the operation of an appliance being associated with said second panel member panel.

7. The improvement as defined in claim 1 wherein said at least one of said first and second panel members is said second panel member, and touch sensor means for controlling the operation of an appliance being associated with said second panel member panel.

8. The improvement as defined in claim 1 wherein said at least one of said first and second panel members is said second panel member, said second panel member and a housing body define a housing having a chamber, control means for controlling the operation of an appliance being located in said chamber, and means for accessing said chamber.

9. The improvement as defined in claim 1 wherein said at least one of said first and second panel members is said second panel member, said second panel member and a housing body define a housing having a chamber, control means for controlling the operation of an appliance being located in said chamber, and means for accessing said chamber by separating the housing body relative to said second panel member.

10. The improvement as defined in claim 5 wherein said at least one of said first and second panel members is said second panel member, said second panel member and a housing body define a housing having a-chamber, control means for controlling the operation of an appliance being located in said chamber, means for accessing said chamber by separating the housing body relative to said second panel member, and said pivoting means pivotally unites said housing body to the first panel member.

11. The improvement as defined in claim 1 wherein said at least one of said first and second panel members is said second panel member, and said second panel member in part defines a control console of an appliance.

12. The improvement as defined in claim 1 wherein said at least one of said first and second panel members is said second panel member, said second panel member in part defines a control console of an appliance, and said second panel member panel is glass.

13. The improvement as defined in claim 5 wherein said at least one of said first and second panel members is said first panel member, and said first panel member panel is a range cook top.

14. The improvement as defined in claim 5 wherein said at least one of said first and second panel members is said first panel member, said first panel member panel is a range cook top, and means for generating heat located immediately beneath a lowermost surface of said first panel member panel.

15. The improvement as defined in claim 1 wherein said at least one of said first and second panel members is said second panel member, said second panel member and a housing body defining a housing having a chamber, said housing body including a peripheral edge, control means for controlling the operation of an appliance being located in said chamber, and means for releasably securing said peripheral edges whereby said chamber can be readily accessed.

16. The improvement as defined in claim 5 wherein said at least one of said first and second panel members is said second panel member, said second panel member includes a rear housing body, and said pivoting means are in part defined by portions of said rear housing body.

17. The improvement as defined in claim 5 wherein said at least one of said first and second panel members is said second panel member, said second panel member includes a rear housing body, and said pivoting means are in part defined by pivot pin portions of said rear housing body.

18. The improvement as defined in claim 5 wherein said at least one of said first and second panel members is said second panel member, said second panel member includes a rear housing body, and said pivoting means are in part defined by socket portions of said rear housing body.

19. The improvement as defined in claim 3 wherein said pivoting means pivotally unites said at least one panel member peripheral edge through its peripheral frame to the other of said first and second panel members.

20. An improvement in an appliance comprising a substantially horizontally disposed first panel member, a second panel member disposed substantially along a first edge of said first panel member, means for pivoting said second panel member for movement relative to said first panel member between a first relatively upright position of said second panel member and a second position of said second panel member angularly offset from said first position toward said first panel member, at least one of said first and second panel members including a panel having a peripheral edge substantially entirely encapsulated by a peripheral frame of one-piece molded synthetic polymeric/copolymeric plastic material, and the other of said first and second panel members includes a panel having a peripheral edge substantially entirely encapsulated by a peripheral frame of a one-piece molded synthetic polymeric/copolymeric plastic material.

21. The improvement as defined in claim 20 wherein said pivoting means pivotally unites said at least one panel member peripheral edge through its peripheral frame to the other of said first and second panel members peripheral frame.

22. An improvement in an appliance comprising a substantially horizontally disposed first panel member, a second panel member disposed substantially along a first edge of said first panel member, means for pivoting said second panel member for movement relative to said first panel member between a first relatively upright position of said second panel member and a second position of said second panel member angularly offset from said first position toward said first panel member, at least one of said first and second panel members including a panel having a peripheral edge substantially entirely encapsulated by a peripheral frame of one-piece molded synthetic polymeric/copolymeric plastic material, the other of said first and second panel members includes a panel having a peripheral edge substantially entirely encapsulated by a peripheral frame of a one-piece molded synthetic polymeric/copolymeric plastic material, and said pivoting means pivotally unites said peripheral edges to each other.

23. The improvement as defined in claim 22 wherein said pivoting means pivotally unites said peripheral edges to each other through said peripheral frames.

24. An improvement in an appliance comprising a substantially horizontally disposed panel member, a console disposed substantially along a first edge of said substantially horizontally disposed panel member, said console including front and rear housing bodies defining therebetween an interior chamber, means for securing said front and rear housing bodies to each other, said front housing body including a glass panel having a peripheral edge substantially entirely encapsulated by a peripheral frame of one-piece molded synthetic polymeric/copolyineric plastic material, and means for pivotally connecting said rear housing body for pivotal movement relative to said substantially horizontally disposed panel member between a first relatively upright position of said console and a second position of said console angularly offset from said first position toward said substantially horizontally disposed panel member and with an upper edge of said console being more closely adjacent said substantially horizontally disposed panel member in said second position than in said first position.

25. The improvement as defined in claim 24 including touch sensor means for controlling the operation of an appliance being associated with said glass panel.

26. The improvement as defined in claim 25 including control means in said interior chamber for controlling the operation of an appliance.

27. The improvement as defined in claim 24 including control means in said interior chamber for controlling the operation of an appliance.

28. The improvement as defined in claim 27 wherein said securing means are releasable securing means for releasably securing said front and rear housing bodies relative to each other.

29. The improvement as defined in claim 24 wherein said securing means are releasable securing means for releasably securing said front and rear housing bodies relative to each other.

30. The improvement as defined in claim 29 wherein said first panel member defines at least in part a cook top panel.

31. The improvement as defined in claim 24 wherein said first panel member defines at least in part a cook top panel.

32. The improvement as defined in claim 24 wherein said first panel member defines at least in part a cook top panel of a range.

33. The improvement as defined in claim 24 wherein said first panel member defines at least in part a clothes washer.

34. The improvement as defined in claim 24 wherein said first panel member defines at least in part a dishwasher.

35. The improvement as defined in claim 24 wherein said first panel member defines at least in part a clothes dryer.

36. An improvement in an appliance comprising a substantially horizontally disposed panel member, a console disposed substantially along a first edge of said substantially horizontally disposed panel member, said console including an uppermost edge and front and rear housing bodies defining therebetween an interior chamber, and means for pivotally connecting said rear housing body for pivotal movement relative to said substantially horizontally disposed panel member between a first relatively upright position of said console and a second position of said console angularly offset from said first position toward said substantially horizontally disposed panel member and with said upper edge of said console being more closely adjacent said substantially horizontally disposed panel member in said second position than in said first position.

37. The improvement as defined in claim 36 wherein said front housing body includes a peripheral edge of one-piece molded synthetic polymeric/copolymeric plastic material encapsulating a peripheral edge of said glass panel.

* * * * *